United States Patent [19]

Fritzsche et al.

[11] 4,405,168

[45] Sep. 20, 1983

[54] CLAMPING ASSEMBLY FOR LIFTING HEAVY OBJECTS HAVING A BULBOUS ENGAGEMENT PORTION

[75] Inventors: Eldred N. Fritzsche, Kirkwood; Edgar F. Josephson, St. Charles, both of Mo.; Frank C. Pulcrano, Huntington, W. Va.

[73] Assignee: ACF Industries, Incorporated, New York, N.Y.

[21] Appl. No.: 206,418

[22] Filed: Nov. 13, 1980

[51] Int. Cl.[3] ..... B66C 1/42

[52] U.S. Cl. ..... 294/103 R; 294/88

[58] Field of Search ..... 294/103 R, 103 CG, 27 R, 294/34, 82 R, 67 BB, 81 R, 86 R, 86 LS, 87 R, DIG. 2; 414/656, 657, 658, 590, 618, 620, 621, 622, 780, 784

[56] References Cited

U.S. PATENT DOCUMENTS

| | | | |
|---|---|---|---|
| 2,910,321 | 10/1959 | Sehn et al. | 294/88 |
| 3,153,555 | 10/1964 | Kaplan et al. | 294/88 |
| 3,792,782 | 2/1974 | Melton | 294/103 R |
| 4,236,744 | 12/1980 | Reinders | 294/88 |
| 4,256,429 | 3/1981 | Dwyer | 294/103 R |

*Primary Examiner*—James B. Marbert

*Attorney, Agent, or Firm*—Henry W. Cummings

[57] ABSTRACT

The clamping assembly includes a pair of clamping arms extending outwardly from a clamp base portion. Each arm includes a cutaway portion to receive the bulbous engagement portion of the article to be lifted and a front gripping portion to engage and grip a non-bulbous, preferably generally flat portion of the article. At least one arm is movable and is pivotably mounted about the base portion for movement between a clamping position in which the gripping portion of the arm engages and grips the non-bulbous portion of the article to be lifted, and an open position wherein the gripping portion of the movable arm is located away from the gripping portion of the other arm to allow entry or removal of the article. The base portion is pivotably mounted about a clamp support whereby the assembly may be used either vertically or horizontally. The clamp support includes means to support the clamp assembly by means of cables extending from an overhead crane. Drive means such as an electric motor is mounted on the base portion to move the movable arm(s) between closed and open position. Limit switch means are provided which turn off the drive means when the movable arm(s) has reached the open and closed positions. Safety means are provided whereby power to close the clamp cannot be activated unless the bulbous portion of the article to be lifted is in place within the cutaway portions of the arms. Additional safety means are provided in the crane support whereby the movable arm(s) cannot be moved from closed to open position so long as a predetermined weight is being carried by the clamp assembly.

33 Claims, 5 Drawing Figures

CLAMPING ASSEMBLY FOR LIFTING HEAVY OBJECTS HAVING A BULBOUS ENGAGEMENT PORTION

BACKGROUND OF THE INVENTION

Previously heavy articles having an enlarged or bulbous portion and a generally flat portion such as a railway car side (the side sill and/or side plate constitute the bulbous portion and the side sheet constitutes the flat portion) were lifted by a manually assembled clamping assembly. This assembly included an angled shaped plate which engaged the bulbous portion and a flat plate which engaged the opposite face of the side sheet. Fastening bolts were inserted through the abutting plates and then a crane hook was inserted through larger aligned openings in the two plates.

Attachment of these fastening bolts was time consuming. Furthermore, if large articles such as a railway car side were placed vertically on the shop floor, it was often difficult for the operator to locate himself on a ladder in position to apply the clamping assembly to the bulbous portion.

One object of the present invention is to provide a crane and clamp assembly for lifting heavy articles having a bulbous portion and a generally flat portion wherein the clamp assembly can be controlled to automatically engage the bulbous portion without manual attachment of fasteners.

Another object of the present invention is to provide a crane and clamping assembly which can pick up heavy articles having a bulbous portion and a generally flat portion from both a vertical and a horizontal resting position.

Another object is to provide a crane and clamping assembly which can be controlled from the clamping assembly or from the crane.

Other objects will be apparent from the following description and drawings.

SUMMARY OF THE INVENTION

The clamping assembly includes a pair of clamping arms extending outwardly from a clamp base portion. Each arm includes a cutaway portion to receive a bulbous portion of the article to be lifted, and a front gripping portion to engage and grip a non-bulbous, preferably generally flat portion of the article. At least one arm is movable and is pivotably mounted about the base portion for movement between a clamping position in which the gripping portions of the fixed and movable arm(s) engage and grip the non-bulbous portion of the article to be lifted, and an open position wherein the gripping portion of the movable arm(s) is located away from the gripping portion of the other arm to allow entry or removal of the article. Drive means mounted on the base portion are provided to move the movable arm(s) between open and closed positions.

The base portion is pivotably mounted about a clamp support whereby the clamp assembly may be used in any direction. The clamp support includes means to support the clamp assembly by means of cables extending from an overhead crane. Stop means are provided on the base portion and on the crane support which engage when the clamp extends vertically downwardly below the crane support to lock the base portion against the clamp arm and prevent significant rotation of the arms. Additional stops engage in the horizontal position, which allow the base portion to be rotated 180° to clamp articles to be lifted horizontally on either side of the crane support.

The gripping portions of the arms preferably comprises a pair of thick plates rigidly connected to the respective arms. The drive means for the movable arm(s) may comprise an electric motor or internal combustion engine. The drive means includes an operating shaft extending therefrom. Gear means attached to the operating shaft engage the movable arm(s) to move the movable arm(s) between closed and open positions. In one embodiment the operating shaft is a worm shaft which drives an operating nut mounted on the movable arm(s). Limit switches are provided which turn off the drive means when the movable arm(s) has reached the open and closed positions respectively.

Safety means are provided whereby power to close the clamp cannot be activated unless the bulbous portion of the article to be lifted is located within the cut out portions of the arms. In one embodiment, this safety means comprises a contact member pivotably mounted upon the base portion and/or upon a fixed arm which the bulbous portion of the article engages when the bulbous portion is in place within the cutaway portions of the arms and which pivots the contact member into engagement with a fixed contact which completes an electrical circuit and allows activation of the drive means for the movable arm(s).

Weight safety means are provided in the crane support whereby the movable arm(s) cannot be moved from closed to open position so long as a predetermined weight is being carried by the clamp assembly. In one embodiment, this safety means comprises a resilient means biasing an electrical contact in closed position which allows the movable arm(s) to move from closed to open position. When a predetermined load is applied the load will move the contact into a disengaged position, disengaging the electrical circuit and preventing movement of the movable arm(s) to open position until the load is no longer bearing on the resilient means, at which time the contact returns to the engaged position.

One of the arms is preferably longer than the other to aid in aligning the arms with the article to be lifted. The operating shaft preferably includes an outwardly extending non-round portion to allow for manual operation of the movable arm(s) in the event of failure of the drive means and/or electrical power failure.

Control means for operating the clamping assembly are located on the clamping assembly, on the overhead crane, or may depend from the crane to provide ease of operation.

IN THE DRAWINGS

DESCRIPTION OF PREFERRED EMBODIMENTS

Figure 3:
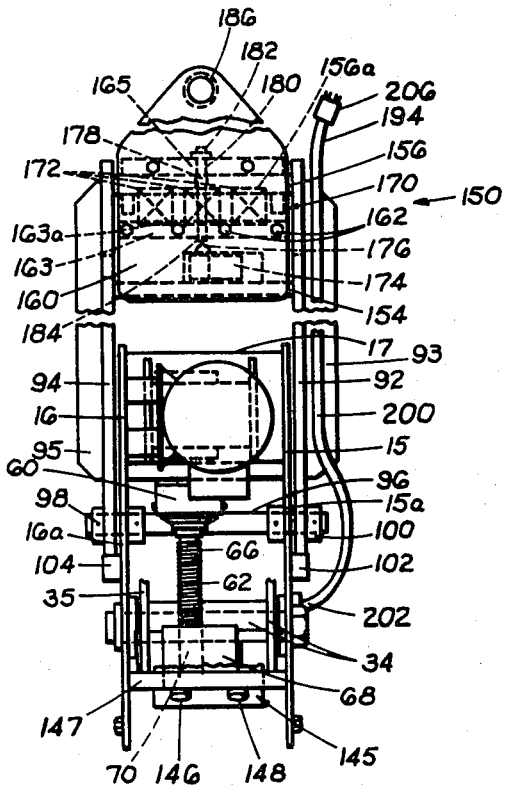
FIG. 3 is an end elevation view of FIG. 2.

In the drawings the clamping assembly of the present invention is indicated generally at 10. The clamping assembly includes a base portion 12 to which is integrally connected a fixed arm 14. The fixed arm and base portion can be conveniently made of a single fabrication including a pair of laterally spaced plates 15 and 16 joined by a top plate 17 (FIG. 3). Plates 15 and 16 include a cutaway portion 18 including a first inclined wall 20, a generally flat wall 22 and a second inclined wall 24. A plate 26 extends behind and supports wall portions 20, 22 and 24. Fixed arm 14 further includes a clamping or gripping portion 30 at the outer end of body portion 26. Clamping or gripping portion 30 includes a relatively thick flat steel plate 32 welded to plates 15, 16, 17 and 26.

A movable arm 33 is pivotably mounted about base portion 12 by means of a laterally extending pin 33*a*. Movable arm 33 includes a pair of plates 34 and 35 each of which has a flat wall portion 36 and an inclined wall portion 37 to define a movable arm cutaway portion 38. Optional closure plates 39 and 40 are welded to plates 34 and 35. At the outer end of arm 33 a gripping portion 41 is provided. Gripping portion 41 includes a thick steel plate welded to plates 34, 35, 39 and 40. Plate 41 is shorter than fixed member gripping plate 32 by 3 or 4 inches. It is apparent that a base cutaway portion 43 is in part defined by a wall 44 found on base portion 12. Thus cutaway portion 18, 38 and 43 define an opening 45 to receive a bulbous portion B of a heavy article A having a generally flat portion S which is engaged by gripping plates 32 and 42.

Figure 2:
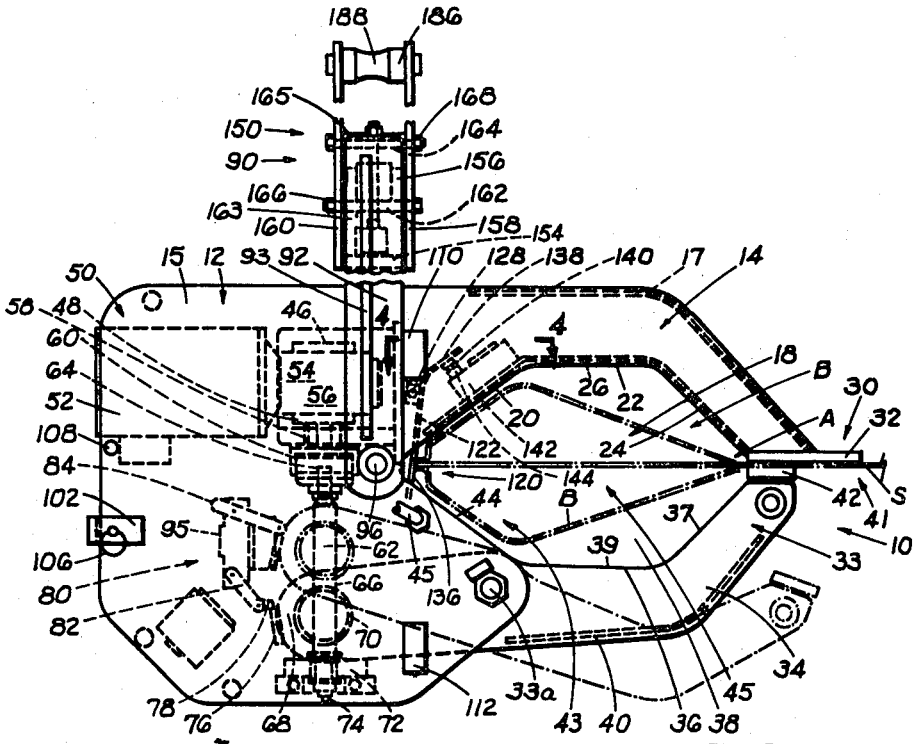
FIG. 2 is a side elevation view of the clamping assembly with the arms extending in a horizontal direction relative to the crane support.

Brackets 46 and 48 extending from base portion 12 mount a drive means indicated generally at 50. Drive means 50 may comprise an electric motor 52, for example a $\frac{1}{3}$ horse power 440 volts AC. Alternatively, drive means 50 may comprise an internal combustion engine (not shown). A drive shaft 54 extends out of drive means 50 and engages a right angle gear box 56 of conventional construction which has an operating shaft 58 extending therefrom. A slip clutch 60 of known construction, for example, Dalton Gear Co. OSD 337 located 214 Colfax, Minneapolis, Minn., is connected to operating shaft 58. A worm shaft 62 has a first engagement portion with clutch 60 and includes a threaded portion 66 which receives an operating nut 68 mounted upon movable arm 38. The operating nut 68 has threads 70 which engage the threads 66 on shaft 62. It will thus be apparent that drive means 50 (motor 52) is effective to rotate shaft 62 in a first direction to move movable arm 33 between an open position shown in dotted lines in FIG. 2 to a closed position shown in solid lines with gripping plate 42 adjacent fixed gripping plate 32. Operating shaft 62 includes a shaft bearing 72 and is provided with an external non-round operating connection portion 74 to receive a suitable tool to manually rotate the shaft 62 in the event of a power failure or failure of drive means 50.

Limit switch means 80 are provided to control movement of the operating nut between open and closed position. Operating nut 68 is provided with a contact mounting bracket 76 and an electrical contact 78. The limit switch means further includes an open position contact 82 and a closed position contact 84. Contacts 82 and 84 are mounted upon a contact bracket 85. When the arm 33 assumes the closed position engaging a flat portion S of an article to be lifted, the contact 78 engages the contact 84 which turns off the drive means 50. Similarly, when the arm 33 assumes the full open position the contact 78 engages the contact 82 and the drive means 50 is turned off.

In accordance with one feature of the present invention, safety means 120 are provided which prevent arm 33 from moving from the open to the closed position unless an article A is positioned within the opening 45. This means is designed to prevent inadvertent closure of the arm 33, for example upon an operator's hand. In one embodiment, the safety means 120 comprises a contact member 122 pivotably mounted upon brackets 124 and 126 (FIG. 4) by means of a pin 128 having a head 130, and a nut 132 and a cotter pin 134. Contact arm 122 has a first end 136 which is adopted to be engaged by an upper bulbous portion B1 of the article A, when the bulbous portion is fully located within the opening 45 and is adjacent the base portion 44. The contact arm 122 includes a second end 138 which is bent and a contact 140 is welded thereto.

A limit switch 142 mounted on fixed arm plate 26 by welding includes a contact 144 which is adopted to be engaged by the contact 140 when the bulbous end B1 pivots the contact arm 122 about the pivot pin 128. When the contact 140 engages the contact 144, an electrical circuit is completed and drive means 50 may then be activated to rotate shaaft 62 and move arm 33 from the open to the closed position.

When the bulbous article A is removed, it is apparent that the contact arm 122 will pivot to its original position by gravity and contact 140 will no longer be in contact with contact 144. Until another bulbous portion engages contact arm 122 and moves it into engagement with contact 144 drive means 50 cannot be activated.

A clamp support 90 includes a pair of vertical plates 92 and 94 (FIG. 3) having respective reinforcing gussets 93 and 95. A laterally extending pin 96 extending through openings 15*a* and 16*a* in plates 15 and 16 mountes the base 12 about the plates 92 and 94. Pin 96 is held in place with a cotter pin 98 and a nut 100. Openings 15*a* and 16*a* are located in the base portion at a position such that the weight of arms 14 and 33 bias the base portion 12 and arms 14 and 33 into a vertical position. Stops 102 and 104 welded respectively to plates 15 and 16 are provided in which plates 92 and 94 abut in vertical position. A pin 106 is removed from its mounting place in stop 102 and is used to trap plates 92 and 94 by passing the pin through the opening 108 in the base plate 15. Thus with pin 108 in place, base 12 and arms 14 and 33 are rigidly held in the vertical position.

Upon removal of pin 108, base 12 and arms 14 and 33 can be pivoted about pin 96. Stops 110 are provided on plates 15 and 16 which allow arms 14 and 33 to extend horizontally to the right as viewed in FIG. 2, to pick up or lower a bulbous article A. Similarly, stops 112 are provided on plates 15 and 16 to allow rotation of base 12 and arms 14 and 33 about pin 96 so that arms 14 and 33 may extend horizontally to the left in FIG. 2 perpendicular to clamp support plates 92 and 94. It is thus seen that base 12 and arms 14 and 33 are movable for 180° to extend horizontally in either direction from clamp support 90.

For use in the horizontal position, the base portion 12 is provided with a control means 145 comprising open and closed switches 146 and 148 mounted upon a transverse control panel 147 extending between plates 15 and 16. In addition, drive means 50 is also operated by an electrical control located on an overhead crane 194 or which depends from overhead crane 194.

Load safety means 150 are provided whereby when a bulbous article A is being lifted by the arms 14 and 33, arm 33 cannot move from the closed to the open position until such time as the weight of this article is relieved. Load safety means 150 includes a pair of plates 154 and 156 which extend laterally between vertical plates 92 and 94. Clamp support plates 158 and 160 extend on either side of plates 92 and 94. A plurality of fasteners 162 extend between plates 158 and 160 which mount a plate 163 at one vertical level and a plurality of additional fasteners 164 extend further between plates 158 and 160 and mount another plate 165. Fasteners 162 and 164 are provided respectively with appropriate fastening nuts 166 and 168.

A resilient means 170 comprising a plurality of compression springs 172 is located between plates 156 and 163. Plates 156 and 163 are provided respectively with spring receiving slots 156*a* and 163*a*. A switch 174 mounted upon plate 154 includes a fixed contact point 176. A movable contact member 178 is threaded at 180 into plate 165 and receives a nut 182 to hold it in place. Contact member 180 includes a contact tip 184. Compression springs 172 bias contact member 180 in an engaged position with fixed contact 176. In this engaged position a circuit is completed and drive means 50 can thus drive movable arm 33 between open and closed positions.

Figure 5:
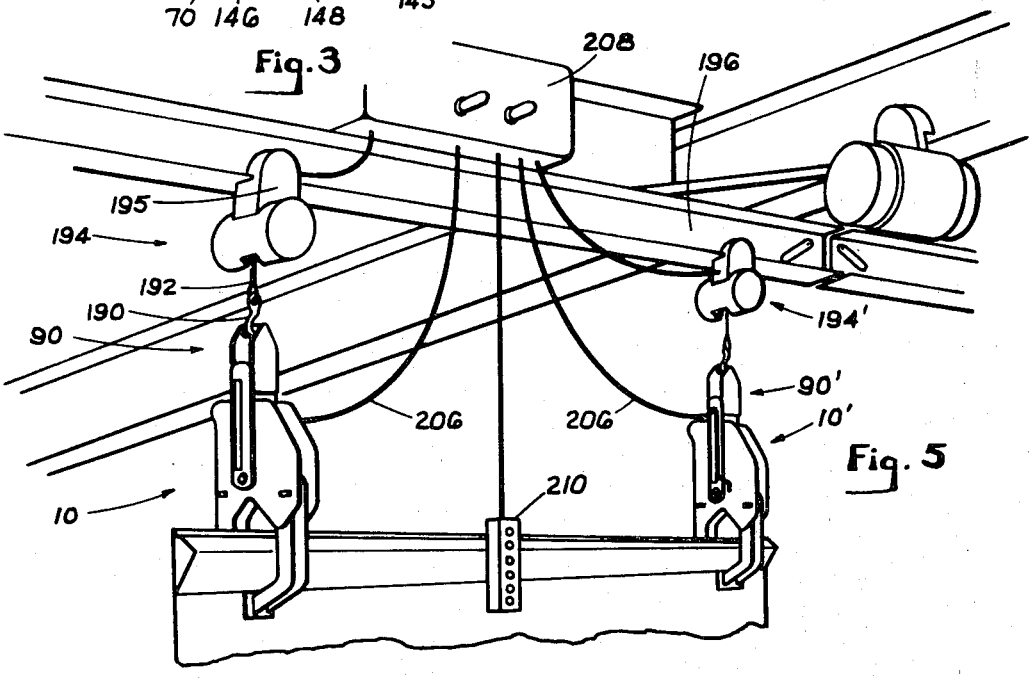
FIG. 5 is a view in perspective illustrating the use of a pair of clamps supported by a pair of overhead cranes.

A connector pin 186 extends between plates 158 and 160. Connector pin 186 includes a hook engagement area of reduced cross seciton 188 to receive a hook 190 connected to a cable 192 extending to an overhead crane 194 having a trolly 195 of conventional construction (FIG. 5). Thus the assembly of plates 158, 160, connector hook 186, plates 163 and 165 is an integral assembly which moves together. When the load of the heavy article A is applied to by plates 158 and 160 and crane hook attachment 188, the plate 163 overcomes the bias of the springs 172 and moves the contact member 180 attached to plate 165 vertically to a position out of engagement with the contact member 184. This provides an open circuit to the drive means 50 and prevents operation thereof until such tim the article A is lowered to a position where the article is supported by a floor or base and the load is no longer transmitted to the plates 158 and 160. When this occurs the bias of the springs 172 will then move the contact member 180 downwardly into engagement with the contact 176. Then the drive means can again be activated to move the arm 33 to the open position.

It is thus seen that this is an important safety feature. So long as the load is applied to the overhead crane, and the plates 158 and 160 overcome the bias of the springs 172, the drive means 50 cannot be turned on to move the arm 33 into open position and thus allow the heavy article A to escape from the clasped position between arms 14 and 33.

A cable 200 is connected to one end 202 to the control means 145. The opposite end 204 is provided with a connection 206 to engage an electrical system extending to a crane control 208. The crane 194 and drive means 50 can thus be operated from crane control 208. Alternatively, a depending operation 210 may be connected to the crane control operation of the crane and the clamp assembly 10 by means of an operator located on the floor.

Figure 1:
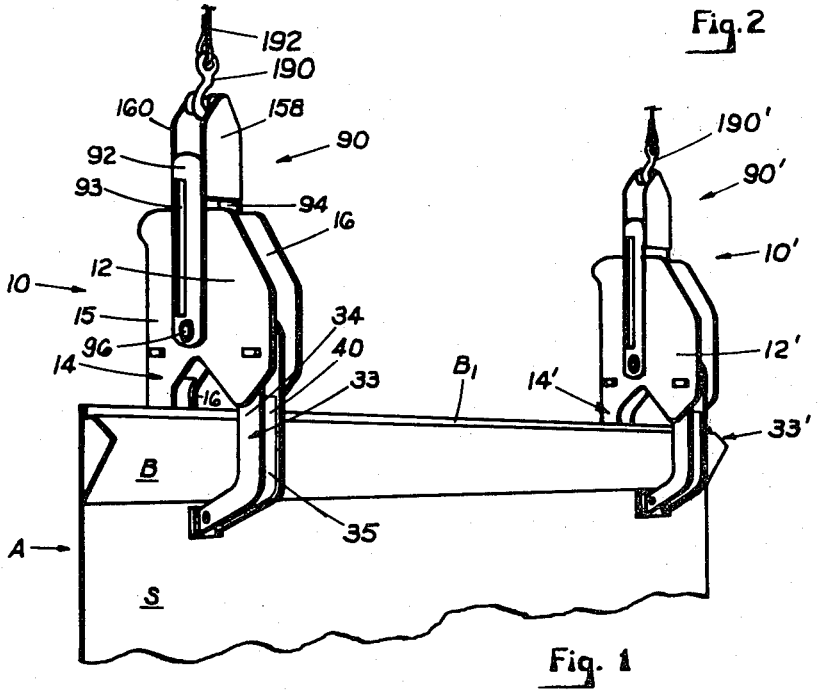
FIG. 1 is a schematic perspective view illustrating the clamping assembly of the present invention.
Figure 4:
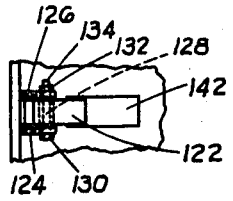
FIG. 4 is a plan view looking in the direction of the arrows along the line 4—4 in FIG. 2.

As shown in FIGS. 1 and 4, it is often desirable to use a pair of clamp assemblies 10,10' and crane constructed in the same manner, supported one or more overhead cranes 194,194' to lift relatively long, heavy articles, and move them along an overhead crane track 196. This movement may be controlled by crane control 208 or by depending operator 210.

It is thus seen that heavy article A having a bulbous portion B can be engaged in either a horizontal position (FIG. 2) or a vertical position with the clamp assembly of the present invention.

The clamp assembly of the present invention also can be entirely controlled by the operator with a depending electrical control of known construction.

Safety means 120 prevent the movable arm 33 to close unless an article having a bulbous portion is in place within the opening 45.

Additional load bearing safety means 150 are provided whereby the electrical circuit controlling movement of the movable arm 33 to open position is maintained in an open circuit position by the weight of the article. This materially reduces the liklihood that the heavy article will come out in transit between storage points.

In the event of drive means power failure or power failure to the entire plant, a non-round tool connector can be attached to the shaft connection portion 74 and the arm 33 moved between open and closed positions in an emergency.

What is claimed is:

1. A clamping assembly for lifting heavy objects having a bulbous engagement portion comprising: a pair of clamping arms extending outwardly from a clamp base portion; each arm including a cutaway portion to receive the bulbous engagement portion of the article to be lifted, and a front gripping portion to engage and grip a non-bulbous portion of the article; at least one of said arms being movable and being pivotably mounted about the base portion for movement between a clamping position in which the gripping portion of the arms engage and grip the non-bulbous portion of the article to be lifted, and an open position wherein the gripping portion of the movable arm is located away from the gripping portion of the other arm to allow entry or removal of the article; drive means mounted on said base portion to move said movable arm between open and closed positions; said base portion being pivotably mounted about a crane support whereby the clamp assembly may be used in any direction; said crane support including means to support the clamp assembly by means of cable extending from an overhead crane; and safety means provided whereby said drive means cannot be activated unless the bulbous portion of the article to be lifted is located within the cutout portions of the fixed and movable arms and engages a contract member.

2. A clamping assembly according to claim 1, wherein stop means are provided on the base portion and on the clamp support which engage when the base portion extends vertically below said crane support.

3. A clamping assembly according to claim 2, wherein when the base portion extends vertically downwardly from the clamp support, said stop means lock the base portion against said clamp support and prevent significant rotation of said clamping arms.

4. A clamping assembly according to claim 2, wherein in horizontal position, stop means are provided which allow the base portion to be rotated 180° and which engage to clamp articles to be lifted on either side of the clamp support.

5. A clamping assembly according to claim 1, wherein the gripping portion of said clamping arms comprises a pair of thick plates rigidly connected to the respective arms.

6. A clamping assembly according to claim 1, wherein one of said arms is longer than the other to aid in aligning the arms with the article to be lifted.

7. A clamping assembly according to claim 1, wherein said operating shaft includes an outwardly extending non-round portion to allow for manual operation of the movable arm.

8. A clamping assembly according to claim 6, wherein said fixed arm is longer than said movable arm.

9. A clamping assembly according to claim 1, wherein pivot means mounting said base portion abut said clamp support are located such that said arms are biased into a generally vertical position.

10. A clamping assembly for lifting heavy objects having a bulbous engagement portion comprising: a pair of clamping arms extending outwardly from a clamp base portion; each arm including a cutaway portion to receive the bulbous engagement portion of the article to be lifted, and a front gripping portion to engage and grip a non-bulbous portion of the article; at least one of said arms being movable and being pivotably mounted about the base portion for movement between a clamping position in which the gripping portion of the arms engage and grip the non-bulbous portion of the article to be lifted, and an open position wherein the gripping portion of the movable arm is located away from the gripping portion of the other arm to allow entry or removal of the article; drive means mounted on said base portion to move said movable arm between open and closed positions; said base portion being pivotably mounted about a crane support whereby the clamp assembly may be used in any direction; said crane support including means to support the clamp assembly by means of cable extending from an overhead crane; and weight safety means provided in said clamp support whereby the movable arm cannot be moved from closed to open position so long as a predetermined weight is being carried by the clamp assembly, said weight safety means comprising a resilient means biasing an electrical contact in closed position and wherein when a load sufficient to overcome the biase of said resilient means is applied to said clamp support said contact will move into a disengaged position preventing movement of the movable arm to open position until the load is no longer carried by said clamp support and the resilient means returns from said contact to closed position.

11. A clamping assembly according to claim 10, wherein said resilient means comprises at least one compression spring mounted upon a spring support plate which is supported by said clamp support, and when said clamp support is supported by an overhead crane, said spring support plate moves said spring and said contact into said disengaged position, providing an open electrical circuit.

12. A crane assembly according to claim 10, wherein said resilient means comprises at least one compression spring mounted upon a spring support plate which is supported by said clamp support, and when said clamp support is supported by said overhead crane, said spring support plate moves said spring and said contact into said disengaged position, providing an open electrical circuit.

13. A crane assembly for lifting heavy objects having a bulbous engagement portion comprising: a clamping assembly including a pair of clamping arms extending outwardly from a clamp base portion; each arm including a cutaway portion to receive the bulbous engagement portion of the article to be lifted, and a front gripping portion to engage and grip a non-bulbous portion of the article; at least one of said arms being movable and being pivotably mounted about the base portion for movement between a clamping position in which the gripping portion of the arms engage and grip the non-bulbous portion of the article to be lifted, and an open position wherein the gripping portion of the movable arm is located away from the gripping portion of the other arm to allow entry or removal of the article; drive means mounted on said base portion to move said movable arm between open and closed positions; a clamp support pivotably mounting said base portion and whereby the clamp assembly may be used in any direction; said clamp support including means for supporting the clamp assembly by means of at least one cable extending from an overhead crane; and weight safety means provided in said clamp support whereby the movable arm cannot be moved from closed to open position so long as a predetermined weight is being carried and engages the clamping assembly.

14. A clamping assembly according to claim 13, wherein said drive means includes an operating shaft extending therefrom and gear means attached to the operating shaft to engage the movable arm to move the movable arm between closed and open positions.

15. A clamping assembly according to claim 14, wherein the operating shaft is a worm shaft which drives an operating nut mounted on the movable arm.

16. A clamping assembly according to claim 14, wherein limit switch means are provided which turn off the drive means when the movable arm has reached the open position and the closed position.

17. A clamping assembly according to claim 16, wherein said limit switch means comprise a contact on said movable arm which engages an open position contact and a closed position contact mounted on said base portion.

18. A crane assembly according to claim 13, wherein stop means are provided on the base portion and on the clamp support which engage when the base portion extends vertically below said clamp support.

19. A crane assembly according to claim 18, wherein when the base portion extends vertically downwardly from the clamp support, said stop means lock the base portion against said clamp support and prevent significant rotation of said clamping arms.

20. A crane assembly according to claim 18, wherein in horizontal position, stop means are provided which allow the base portion to be rotated 180° and which engage to clamp articles to be lifted on either side of the clamp support.

21. A crane assembly according to claim 13, wherein pivot means mounting said base portion abut said clamp support are located such that said arms are biased into a generally vertical position.

22. A crane assembly according to claim 13, including means for controlling said drive means located on said base portion.

23. A crane assembly according to claim 13, including means for controlling said drive means from said overhead crane.

24. A crane assembly according to claim 23, wherein said control means depend from said overhead crane.

25. A crane assembly according to claim 13, including a pair of overhead cranes each including a clamping assembly and a clamp support according to claim 21.

26. A crane assembly according to claim 25, wherein control means are provided for similarly controlling each of the overhead cranes and clamp assemblies whereby to lift a single heavy article.

27. A crane assembly according to claim 26, wherein said control means are located adjacent to or within at least one of said overhead cranes.

28. A crane assembly according to claim 27, wherein said control means depend for operation below said cranes.

29. A clamping assembly for liflting heavy objects having a bulbous engagement portion comprising: a pair of clamping arms extending outwardly from a clamp base portion; each arm including a cutaway portion to receive the bulbous engagement portion of the article to be lifted, and a front gripping portion to engage and grip a non-bulbous portion of the article; at least one of said arms being movable and being pivotably mounted about the base portion for movement between a clamping position in which the gripping portion of the arms engage and grip the non-bulbous portion of the article to be lifted, and an open position wherein the gripping portion of the movable arm is located away from the gripping portion of the other arm to allow entry or removal of the article; drive means mounted on said base portion to move said movable arm between open and closed positions; said base portion being pivotably mounted about a crane support whereby the clamp assembly may be used in any direction; said crane support including means to support the clamp assembly by means of cable extending from an overhead crane; and safety means provided whereby said drive means cannot be activated unless the bulbous portion of the article to be lifted is located within the cutout portions of the fixed and movable arms; said safety means comprising a contact member pivotably mounted upon the base portion which the bulbous portion of the article engages when the bulbous portion is in place within the cutout portions, and which pivots the contact member into engagement with a fixed contact which completes an electrical circuit and allows activation of the drive means for the movable arm.

30. A clamping assembly for lifting heavy objects having a bulbous engagement portion comprising: a pair of clamping arms extending outwardly from a clamp base portion; each arm including a cutaway portion to recevive the bulbous engagement portion of the article to be lifted, and a front gripping portion to engage and grip a non-bulbous portion of the article; at least one of said arms being moveable and being pivotably mounted about the base portion for movement between a clamping position in which the gripping portion of the arms engage and grip the non-bulbous portion of the article to be lifted, and an open position wherein the gripping portion of the movable arm is located away from the gripping portion of the other arm to allow entry or removal of the article; drive means mounted on said base portion to move said movable arm between open and closed positions; said base portion being pivotably mounted about a crane support whereby the clamp assembly may be used in any direction; said crane support including means to support the clamp assembly by means of cable extending from an overhead crane; and weight safety means provided in said crane support whereby the movable arm cannot be moved from closed to open position so long as a predetermined weight is being carried by and engages the clamp assembly.

31. A clamping assembly for lifting heavy objects having a bulbous engagement portion comprising: a pair of clamping arms extending outwardly from a clamp base portion; each arm including a cutaway portion to receive the bulbous engagement portion of the article to be lifted, and a front gripping portion to engage and grip a non-bulbous portion of the article; at least one of said arms being movable and being pivotably mounted about the base portion for movement between a clamping position in which the gripping portion of the arms engage and grip the non-bulbous portion of the article to be lifted, and an open position wherein the gripping portion of the movable arm is located away from the gripping portion of the other arm to allow entry or removal of the article; drive means mounted on said base portion to move said movable arm between open and closed positions; said base portion being pivotably mounted about a crane support whereby the clamp assembly may be used in any direction; said crane support including means to support the clamp assembly by means of cable extending from an overhead crane; and safety means provided whereby said drive means cannot be activated unless the bulbous portion of the article to be lifted is located within the cutout portions of the fixed and movable arms and engages the contact member; and wherein weight safety means are provided in the crane support; whereby the movable arm cannot be moved from closed to open position so long as the predetermined weight is being carried by and engages the clamp assembly.

32. A clamping assembly for lifting heavy objects having a bulbous engagement portion comprising: a pair of clamping arms extending outwardly from a clamp base portion; each arm including a cutaway portion to receive the bulbous engagement portion of the article to be lifted, and a front gripping portion to engage and grip a non-bulbous portion of the article; at least one of said arms being movable and being pivotably mounted about the base portion for movement between a clamping position in which the gripping portion of the arms engage and grip the non-bulbous portion of the article to be lifted, and an open position wherein the gripping portion of the movable arm is located away from the gripping portion of the other arm to allow entry or removal of the article; drive means mounted on said base portion to move said movable arm between open and closed positions; said base portion being pivotably mounted about a crane support whereby the clamp assembly may be used in any direction; said crane support including means to support the clamp assembly by means of cable extending from an overhead crane; and safety means provided whereby said drive means cannot be activated unless the bulbous portion of the article to be lifted is located within the cutout portions of the fixed and movable arms; and wherein weight safety means are provided in the crane support; whereby the movable arm cannot be moved from closed to open position so long as the predetermined weight is being carried by the clamp assembly; said weight safety means comprising a resilient means biasing an electrical contact in closed position, and wherein when a load sufficient to overcome the bias of said resilient means is applied to said crane support said contact will move into a disengaged position preventing movement of the movable arm to open position until the load is no longer carried by said crane support and the resilient means returns said contact to closed position.

33. A clamping assembly for lifting heavy objects having a bulbous engagement portion comprising: a pair of clamping arms extending outwardly from a clamp base portion; each arm including a cutaway portion to receive the bulbous engagement portion of the article to be lifted, and a front gripping portion to engage and grip a non-bulbous portion of the article; at least one of said arms being movable and being pivotably mounted about the base portion for movement between a clamping position in which the gripping portion of the arms engage and grip the non-bulbous portion of the article to be lifted, and an open position wherein the gripping portion of the movable arm is located away from the gripping portion of the other arm to allow entry or removal of the article; drive means mounted on said base portion to move said movable arm between open and closed positions; said base portion being pivotably mounted about a crane support whereby the clamp assembly may be used in any direction; said crane support including means to support the clamp assembly by means of cable extending from an overhead crane; and weight safety means provided in said clamp support whereby the movable arm cannot be moved from closed to open position so long as a predetermined weight is being carried by the clamp assembly.

* * * * *